United States Patent [19]

Suzuki et al.

[11] Patent Number: 4,717,044

[45] Date of Patent: Jan. 5, 1988

[54] APPARATUS FOR DISPENSING COIN PACKAGES

[75] Inventors: Morio Suzuki, Koshigaya; Kenzi Okada, Noda, both of Japan

[73] Assignee: Laurel Bank Machines Co., Ltd., Tokyo, Japan

[21] Appl. No.: 884,369

[22] Filed: Jul. 11, 1986

[30] Foreign Application Priority Data

Sep. 12, 1985 [JP] Japan ..... 60-139884[U]

[51] Int. Cl.[4] ..... G07F 11/28

[52] U.S. Cl. ..... 221/130; 221/195; 221/273; 414/748

[58] Field of Search ..... 221/129, 130, 192, 195, 221/273; 414/276, 748

[56] References Cited

U.S. PATENT DOCUMENTS

| | | | |
|---|---|---|---|
| 3,094,242 | 6/1963 | Kay et al. | 221/273 X |
| 3,750,804 | 8/1973 | Lemelson | 414/276 |
| 4,252,250 | 2/1981 | Toth | 221/195 X |

FOREIGN PATENT DOCUMENTS

| | | | |
|---|---|---|---|
| 1239034 | 7/1960 | France | 221/273 |
| 58-127285 | 7/1983 | Japan . | |
| 58-46749 | 10/1983 | Japan . | |

*Primary Examiner*—F. J. Bartuska

*Attorney, Agent, or Firm*—Fleit, Jacobson, Cohn & Price

[57] ABSTRACT

A plurality of cassette cases for accommodating coin packages are vertically arranged in a coin package dispensing apparatus. An elevator device is disposed to be vertically movable so that it is adapted to be aligned with each of cassette case. The elevator has a discharge cam which transfers coin packages from the cassette cases to the elevator.

2 Claims, 5 Drawing Figures

APPARATUS FOR DISPENSING COIN PACKAGES

BACKGROUND OF THE INVENTION

The present invention relates to an apparatus for dispensing coin packages which is employed in a coin dispenser, a money exchanger or the like.

Heretofore, an apparatus for dispensing coins packaged in rolls has been known in which a large number of coins (50, for example) are piled up and packaged in rolls, and these rolls are accommodated separately according to the types of coin and are dispensed one by one as required.

Referring to FIG. 5, which shows an essential part of a known packaged-coin dispensing apparatus, rakes 1 are rotated around a shaft 2 in the direction shown by the arrow, and are inserted into a cassette case 3 so as to protrude from notches 4 formed in the bottom of the cassette case 3, in such a way that a coin package 5 can be lifted and raked out by the rakes 1.

The coin rolls 5 are packaged in stretched film which is designed to easily tear in the cross-sectional direction along the surfaces of the coins, so that the package can be easily torn off when unwrapping the coins. When the coins packaged in this manner are dispensed by a dispensing apparatus such as that shown in FIG. 5, however, the rakes 1 contact the coin package in the direction in which the stretched film is easily torn. Therefore, when designing the above-mentioned apparatus, it is necessary to consider how to avoid imparting shock to the coin package 5 when it is dispensed and how to protect the film used from damage. It might be considered, for example, to decrease the rotational speed of the rakes 1. This, however, hinders rapid dispensing operation.

In view of the above-described problems, it is a primary object of the present invention to provide an apparatus for dispensing packaged coins in which the wrapping film is not damaged.

SUMMARY OF THE INVENTION

To this end, a coin package dispensing apparatus according to the present invention comprises cassette cases which are mounted in a plurality of stages in the vertical direction within the body of the dispensing apparatus, and an elevator mounted in front of the cassette cases in such a manner that it can be freely raised and lowered, each of the cassette cases having a bottom plate which is slanted toward the direction in which the coin packages are aligned as well as a front plate which regulates the movement of the coin packages along the inclined bottom plate, the elevator having a discharge cam for operating a discharge plate which is disposed below each cassette case and raising the coin packages above the front plate, the discharge cam having a protruding portion which overlaps the position of the discharge plate and a recessed portion which does not overlap the position of the discharge plate when the elevator rises and lowers.

The surface of the coin package is supported when the package is charged into the elevator because the discharge plate is raised by the protruding portion of the discharge cam. At the same time, the elevator can be raised and lowered while the discharge cam is retracted to a position in which it does not overlap the position of the discharge plate by rotating the discharge cam.

DESCRIPTION OF THE DRAWINGS

The present invention will now be described in detail with reference to the preferred embodiment illustrated in the accompanying drawings in which.

DESCRIPTION OF THE PREFERRED EMBODIMENT

The present invention will now be described in detail by referring to the embodiment shown in the accompanying drawings.

An embodiment of the coin package dispensing apparatus according to the present invention will be described hereinunder with reference to FIGS. 1 to 4.

Figure 1:
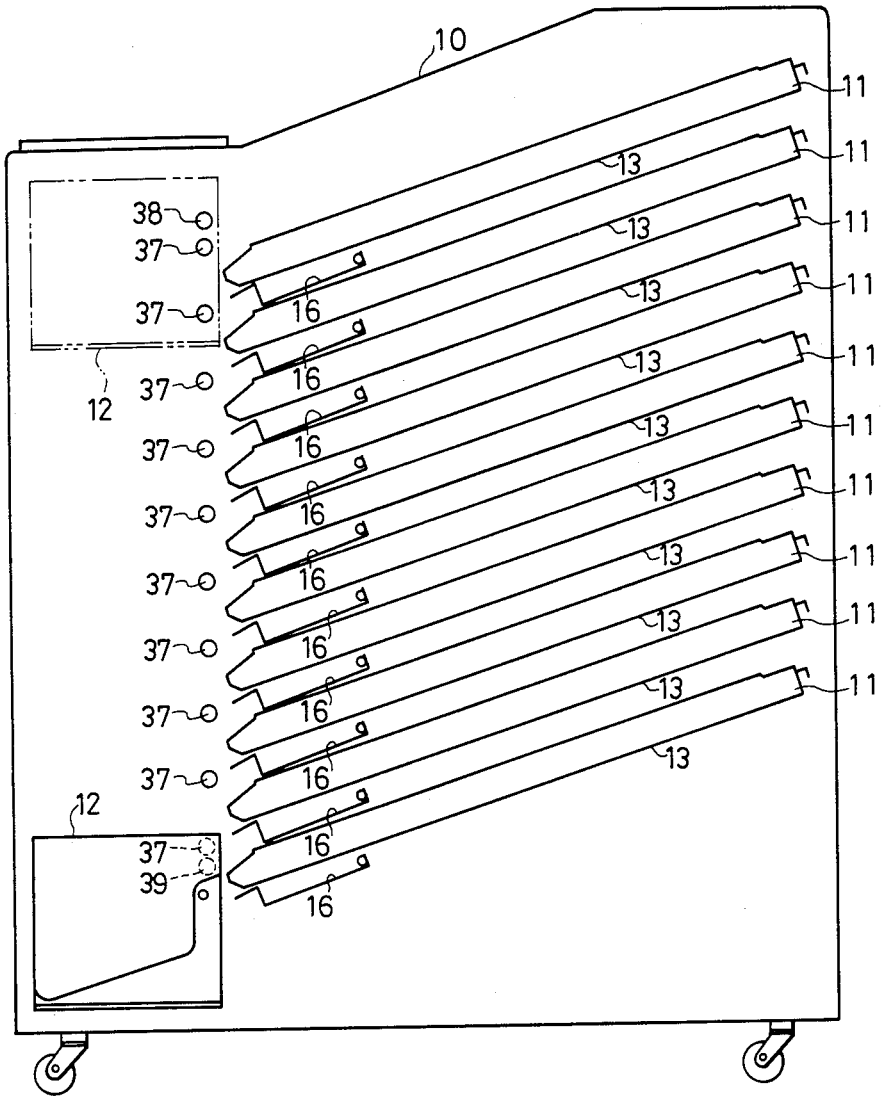
FIG. 1 is a side view of the apparatus, showing its entire view.

Reference numeral 10 designates a dispensing apparatus body, which includes therein cassette cases 11 and an elevator 12. A large number of coin packages 5 are accommodated in each cassette case 11 in such a manner that they are aligned in a row, and the packate-containing cassette cases 11 are aligned in the apparatus in the vertical direction in a number of stages, as shown in FIG. 1. The elevator 12 receives a coin package 5 discharged from the cassette case 11 and rises or lowers. The elevator 12 is mounted in such a manner that it can be freely moved in the direction in which the cassette cases 11 are arranged (in the vertical direction).

Figure 2:
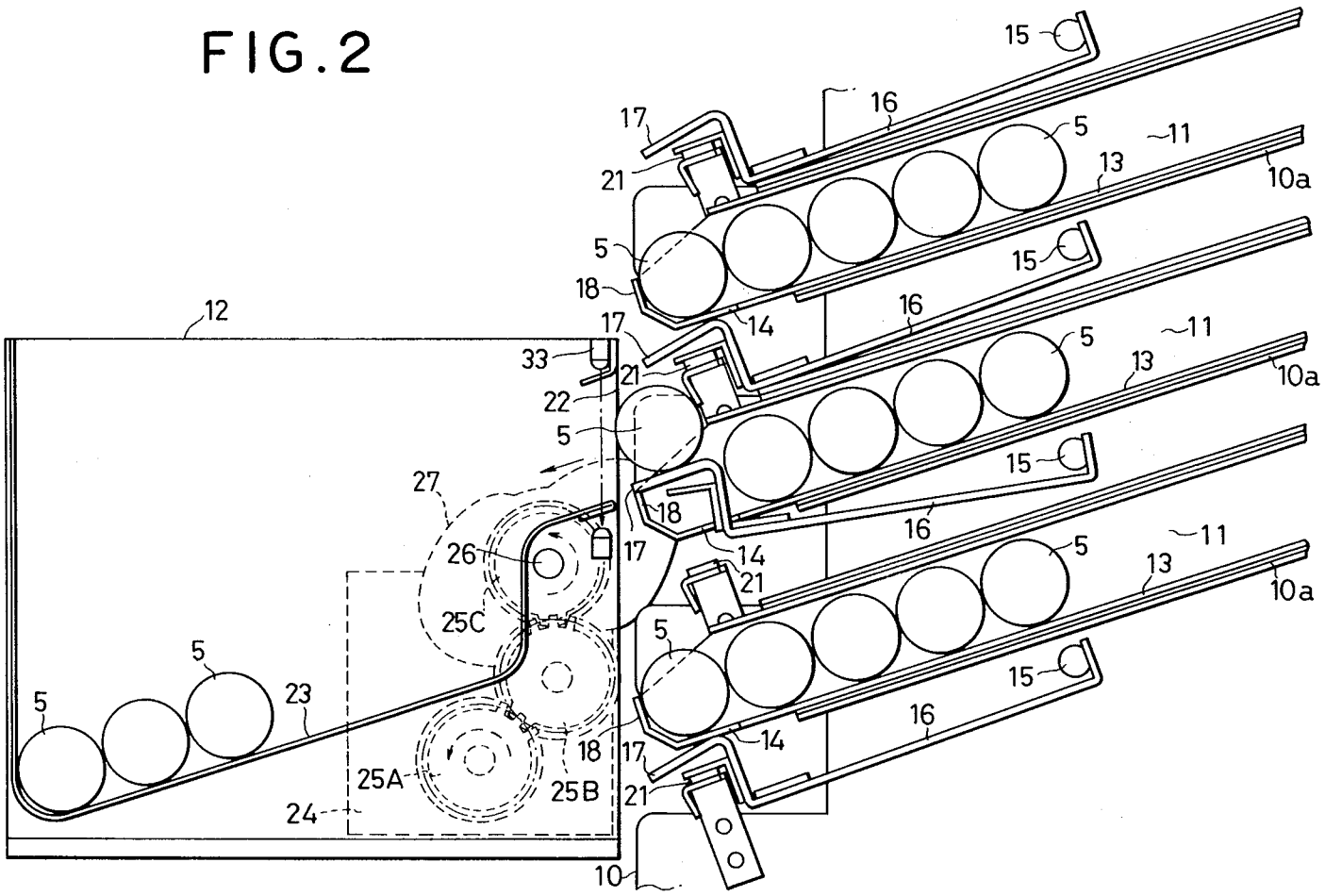
FIG. 2 is a side view of the cassette cases and the elevator contained in the apparatus.

When one of the cassette cases 11 is inserted into the apparatus body 10, as shown in FIG. 2, it is inserted along plate-like case guides 10*a* which are mounted obliquely in the apparatus body 10, with its side edges supported by the case guides 10*a*. The cassette case 11 has an inclined bottom plate 13 on which the coin packages 5 are aligned. The bottom plate 13 has on its distal end (on the forward end at which the coin packages are discharged) a notched portion 14 which has a smaller width than the length of the coin package 5. A support shaft 15 is mounted horizontally between the case guides 10*a*, 10*a* in the widthwise direction of each cassette case 11. A discharge plate 16, which emerges above the bottom plate 13 through the notch 14, is rotationally mounted on the support shaft 15.

The distal end of the discharging plate 16 is bent upward, as shown in FIG. 2. The coin package 5 is raised by this bent portion (hereafter referred to as a "raising portion") 17 above a front plate 18 which is mounted at the distal end of each cassette case and prevents the coin packages 5 from rolling off, and is discharged from that position. A roller supporting plate 19 is mounted on the discharge plate 16 at a position which is closer to the proximal end thereof. A cam follower 20 is pivotally mounted on each end of the roller supporting plate 19, and rotates in contact with a discharge cam to be described later. Further, a stopper 21 is mounted below the discharge plate 16 in the apparatus body 10, and prevents the discharge plate 16 from going below a predetermined level when it contacts the distal end of the discharge plate 16.

Figure 4:
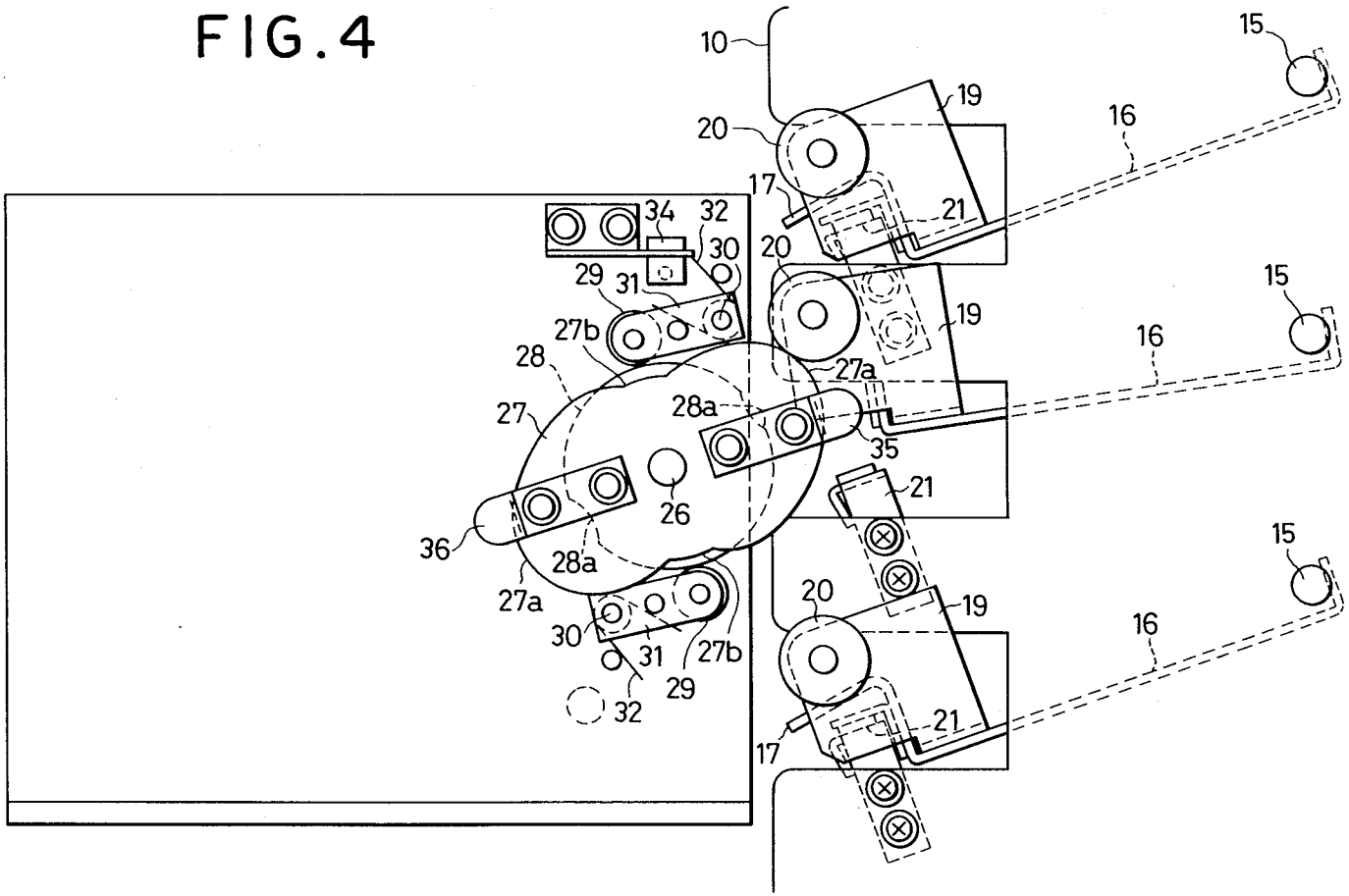
FIG. 4 is a view taken in the direction of the arrows along the line IV—IV of FIG. 3.
Figure 5:
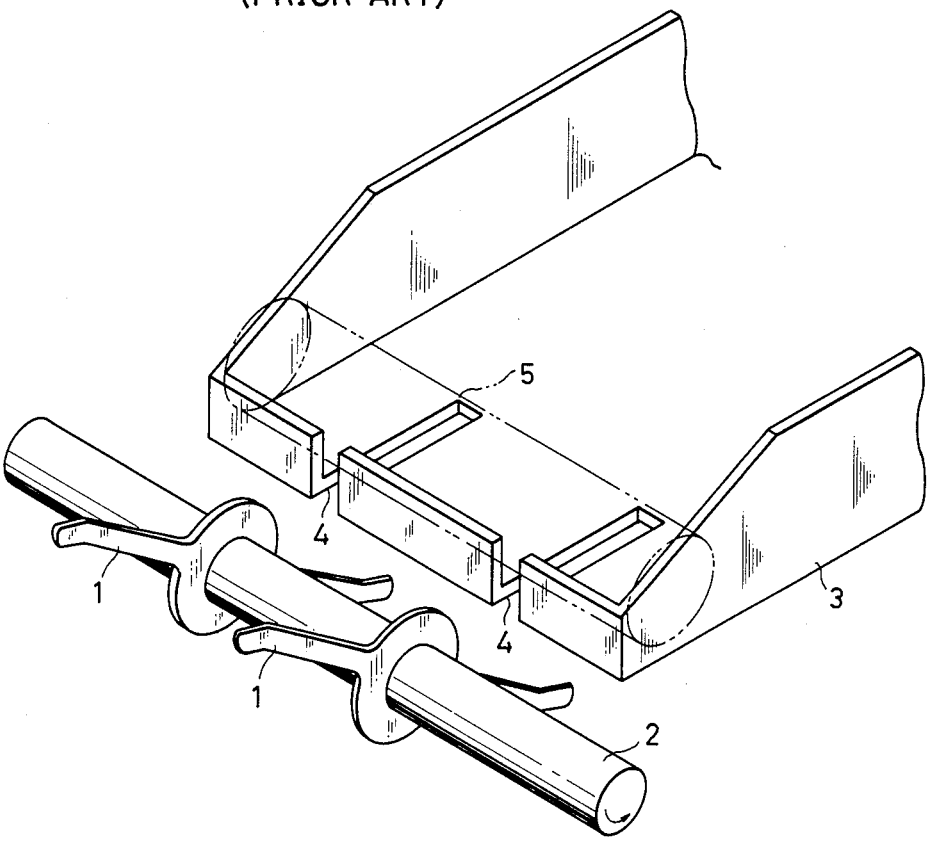
FIG. 5 (PRIOR ART)
FIG. 5 is a perspective view of an essential part of a known coin package dispensing apparatus.

The elevator 12, which is operated by an elevator driving mechanism (not shown), is in the form of a box, and has an opening 22 at the side thereof which is closer to the cassette cases 11. The coin packages are received through this opening 22. A receiving plate 23 is mounted at the inner side of the opening 22 so as to receive the coin packages 5 discharged from the cassette cases 11. The receiving plate 23 is, as shown in FIG. 2, slanted so that it accommodates the coin packages 5 in the state of being aligned in parallel with each other. The elevator 12 has a cam mechanism for operating the discharge plates 16 of the cassette cases 11, as shown in FIG. 4.

Figure 3:
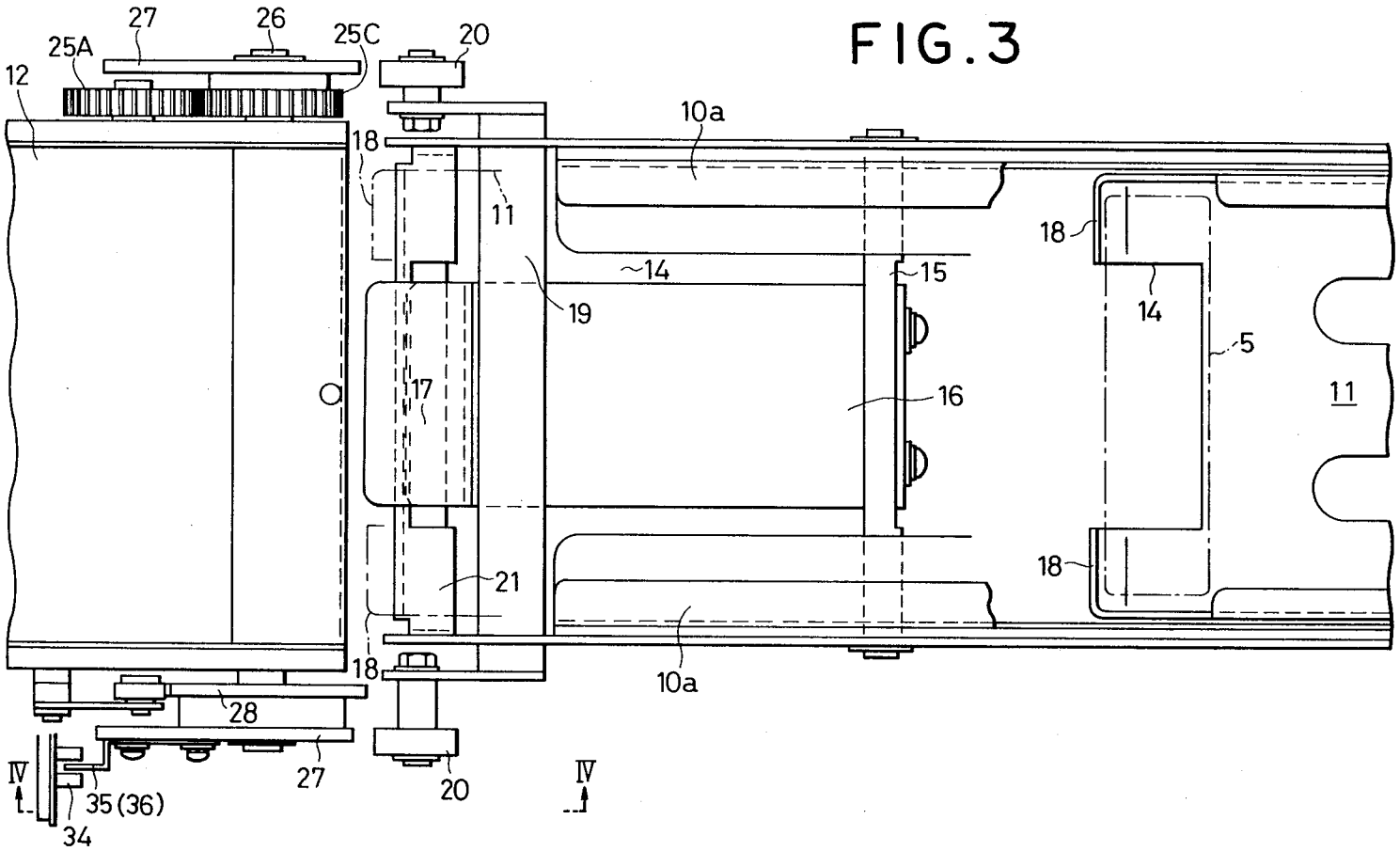
FIG. 3 is a plan view of the same part shown in FIG. 2.

The cam mechanism includes a cam driving motor 24, a camshaft 26 which is coupled to the cam driving motor 24 through gears 25A to 25C, discharge cams 27 and a locking cam 28 which rotate integrally with the camshaft 26. The discharge cam 27 is mounted at each end of he camshaft 26, as shown in FIG. 3, while the locking cam 28 is mounted at one end of the camshaft 26.

The discharge cam 27 has protruding portions **27*a*, 27*a* and recessed portions 27*b*, 27*b*. The protruding portion 27*a* has a radius which allows the discharge cam 27 to project to a position at which the discharge cam 27 intersects the distal end of the discharge plate 16 of the cassette case 11. The recessed portion 27*b* has an outer diameter which does not allow the cam 27 to intersect the distal end of the discharge plate 16. Each pair of protruding portions 27*a* and recessed portions 27*b* are disposed in such a manner that they are separated from each other in the circumferential direction by an angle of 180 degrees. The locking cam 28 is adapted to restrict the rotation of the camshaft 26 by engaging its engaging recesses 28*a* with rollers 29 which are mounted within the elevator 12. The locking cam 28 is shifted in the circumferential direction by substantially 90 degrees relative to the discharge cam 27 so that the engaging recesses 28*a* are engaged with the rollers 29 such as to restrict the rotation of the camshaft 26 when the discharge cam 27 is rotated to an angle in which the recessed portions 27*b* thereof are directed sideways, as viewed in FIG. 4 (to an angle in which the discharge cam 27 is rotated by 90 degrees from the position shown in FIG. 9). In addition, each roller 29 is supported by an arm 31 which is pivotally supported around a shaft 30 and urged in the anticlockwise direction by a torsion spring 31**.

The coin package dispensing apparatus further includes various types of photosensors for, by way of example, sensing the positions of the cams being used.

More specifically, a coin package receiving sensor, which is designated by a reference numeral 33, is activated every time a coin package 5 passes through the opening 22 (every time one package of coins is received). A cam position detecting sensor, which is denoted by a reference numeral 34, is operated by sensor operating plates 35, 36 which are mounted on the discharge cam 27, and detects if the discharge cam 27 is at a discharging position, at which it can move the discharge plate 16, or if the discharge cam 27 is at a retracted position, in which the discharge cam 27 does not overlap the position of the discharge plate 16. The sensors incorporated in the coin package dispensing apparatus further include sensors 37 for detecting if the elevator 12 is disposed at a predetermined position corresponding to each cassette case 11 and sensors 38, 39 that respectively detect if the elevator 12 has reached the upper and lower limits of its operational range (see FIG. 1).

The thus-arranged coin package dispensing apparatus is operated in the following manner so as to dispense a desired number of coin rolls.

(i) First, the coin rolls 5 are separately charged into the cassette cases 11 according to the various types of coin contained therein. At this time, the coin rolls may be distributed in the cassette cases 11 in, for example, the following ratio, depending on the requirements.

1-yen coins: 1 case
5-yen coins: 1 case
10-yen coins: 2 cases
50-yen coins: 2 cases
100-yen coins: 2 cases
500-yen coins: 2 cases The packed cassette cases 11 are then inserted in the apparatus body 10 along the case guides **10*a***.

(ii) When instructed to pay out a certain amount of money in certain types of coins, the elevator 12, which has been standing ready at the lower portion of the apparatus body 10, starts rising. It rises up to a position of the cassette case 11 at which a required type of packed coins is stored. When it has reached this position, the sensor 37 detects the position of the elevator 12 where it is then stopped.

(iii) When the motor 24 is actuated and the camshaft 26 is rotated in the anticlockwise direction as viewed in FIG. 4, the rollers 29 are unlocked from the engaging recesses **28*a* of the locking cam 28, unlocking the camshaft 26, and one of the protruding portions 27*a* of the discharge cam 27 pushes the distal end of the discharge plate 16 upwardly. The raised discharge plate 16 projects above the bottom plate 13 through the notched portion 14, raises the coin roll 5 above the front plate 18, and charges it into the elevator 12 through the opening 22. After one packed roll of coins 5 is dispensed in this manner, the discharge cam 27** may be further rotated for the next roll. It can discharge one coin package every time it is rotated 180 degrees. The above cycle of operation is repeated until the required number of packages is obrained.

(iv) When the required number of packages have been charged into the elevator 12 and the discharge cam 27 is rotated until it is located at a retracted position in which its protruding portions **27*a* are directed upward and downward, the sensor 34 is activated, and the rotation of the discharge cam 27 is stopped. The rollers 29 and the engaging recesses 28*a* of the locking cam 28 then engage with each other, thereby locking the camshaft 26**.

(v) The elevator 12 is raised, and is then positioned in front of the cassette case 11 which contains another type of coins. The required amount of rolled coins 5 is dispensed by repeating the above-described operations from (iii) to (iv), and thereafter the elevator 12 is raised to its upper limit (at which the packages are dispensed), thereby terminating one dispensing operation cycle.

The shapes of the discharge and locking cams are not limited to those described in the above embodiment, and other shapes may alternatively be employed. More specifically, the discharge cam may assume any shape so long as it has a protruding portion which projects to a position in which it overlaps the position of the discharge plate, and a recessed portion which does not overlap the position of the discharge plate and the cassette case when the elevator is moved upward and downward. The locking cam may be omitted.

As will be understood from the foregoing description, the packaged coin dispensing apparatus according to the present invention comprises cassette cases aligned in a plurality of stages in the vertical direction within the body of the dispensing apparatus, and an elevator mounted in front of the cassette cases in such a manner that it can be freely raised and lowered, each of the cassette cases having a bottom plate which is inclined in the direction in which the coin packages are aligned as well as a front plate which restricts the movement of the coin packages in the direction of inclination of the bottom plate, the elevator having a discharge cam for operating the discharge plate disposed below each cassette case and pushing the coin packages up above the front plate, the discharge cam having a protruding portion which overlaps the position of the discharge plate and a recessed portion which does not overlap the position of the discharge plate while the elevator is being raised and lowered. In consequence, it is possible for the surface of a coin package to be pushed while the package is being discharged by raising the discharge plate through the medium of the discharge cam, and therefore the stretched wrapping film is not damaged when the package is discharged.

What is claimed is:

1. An apparatus for dispensing coin packages comprising a plurality of cassette cases each for accommodating a number of coin packages arranged in series, the cassette cases being aligned in a plurality of vertical layers within a body of the dispensing apparatus in a manner whereby they can be freely mounted and removed, the cassette cases each having a front end, an elevator mounted adjacent the front ends of the cassette cases for up and down movement adjacent the front ends of the cassette cases, each of the cassette cases including a bottom plate inclined downwardly toward the front end, a front plate for preventing coin packages from rolling off the front end, and a notch in the bottom plate adjacent the front plate, the apparatus further comprising a plurality of discharge plates pivotally mounted in the body for discharging packages from the respective cassettes, each discharge plate being positioned below the notch of a respective cassette and having a portion adapted to project through the respective notch and raise a coin package above the respective front plate upon upward pivoting movement of the respective discharge plate, and a discharge cam on the elevator, the cam having a protruding portion for operating a selected discharge plate when the elevator is moved to position the cam in juxtaposition to the selected discharge plate in such a manner to upwardly pivot the selected discharge plate and raise a coin package above the front plate of the respective cassette case, the cam further having a recessed portion which may be disposed facing the discharge plate such as to space the cam apart from the discharge plates allowing the elevator to be moved as between the respective cassette cases.

2. An apparatus as defined in claim 1 wherein the discharge cam has a pair of diametrically opposed protruding portions and a pair of diametrically opposed recessed portions.

* * * * *